United States Patent [19]

Cortese, Jr.

[11] 4,378,804

[45] Apr. 5, 1983

[54] FACIAL TREATMENT DEVICE

[76] Inventor: Thomas A. Cortese, Jr., 5411 E. 56th St., Indianapolis, Ind. 46226

[21] Appl. No.: 274,530

[22] Filed: Jun. 17, 1981

[51] Int. Cl.[3] ..... A61H 7/00; A61H 33/00

[52] U.S. Cl. ..... 128/355; 128/56; 15/23; 15/24; 15/28; 15/29; 15/409; 604/46; 604/315

[58] Field of Search ..... 128/355, 305.5, 276, 128/56, 38, 39, 40, 65, 66, 297–302; 15/24, 25, 28, 29, 387, 409, 341, 342; 4/214

[56] References Cited

U.S. PATENT DOCUMENTS

| | | | |
|---|---|---|---|
| 1,837,904 | 12/1931 | Hanelt | 15/24 |
| 1,968,716 | 7/1934 | Smith | 15/409 |
| 2,710,984 | 6/1955 | Grueter | 15/314 |
| 4,203,431 | 5/1980 | Abura et al. | 128/39 |
| 4,292,971 | 10/1981 | Smit et al. | 128/276 |

*Primary Examiner*—Richard J. Apley

*Assistant Examiner*—Sherri Vinyard

*Attorney, Agent, or Firm*—Woodard, Weikart, Emhardt & Naughton

[57] ABSTRACT

Disclosed is a device, intended primarily for home use, for both vacuuming and scrubbing facial skin surfaces to remove oils and debris from the skin. The device is adapted for attachment to a conventional water outlet and comprises a Venturi tube to which is attached a housing overlying the throat suction aperture of the tube. The housing accommodates a turbine rotor which is rotated by the flow of water through the Venturi throat and the rotor drives a remote facial brush. Coaxial with the rotor is a vacuum controlling rotor which may deliver continuous or pulsating vacuum. When producing pulsating vacuum, the rotor periodically interrupts or pulses the vacuum produced in the housing which, via a flexible tube, is utilized by a remote vacuum head applied by the user to his facial surfaces.

5 Claims, 4 Drawing Figures

FACIAL TREATMENT DEVICE

BACKGROUND OF THE INVENTION

A known program for controlling such skin eruptions or lesions as result from acne and similar disorders involves scrubbing, or brushing, the facial skin surfaces, for example, after first applying an appropriate skin cleanser and/or a medicated chemical material. The removal of surface oils and accumulated debris by the scrubbing procedure allows maximum beneficial effect from the treatment. The device embodying the present invention combines a facial brush and a pulsating vacuum head for performing the process referred to above. The kinetic energy of the water flowing through the device, which is adapted for attachment to any conventional water outlet, both rotates a turbine rotor which powers the facial brush and also produces a vacuum at a remote vacuum head. The scrubbing action and the vacuum action are produced by the same device.

In the prior art, suction type devices are disclosed in U.S. Pat. Nos. 2,710,984 and Re. No. 28,405. A water pressure operated turbine is utilized to power a cleaning head in U.S. Pat. No. 3,431,573. Various additional types of vacuum devices and hand-held scrubbing devices are shown in U.S. Pat. Nos. 3,107,386; 4,203,431 and 4,240,173. While the above mentioned prior art shows vacuum devices operated by water flow and scrubbing devices operated by water flow, none show a single, unitary device, operable by conventional domestic water pressure, which is capable of performing both the vacuuming and scrubbing function in facial application.

DESCRIPTION OF THE PREFERRED EMBODIMENT

Figure 1:
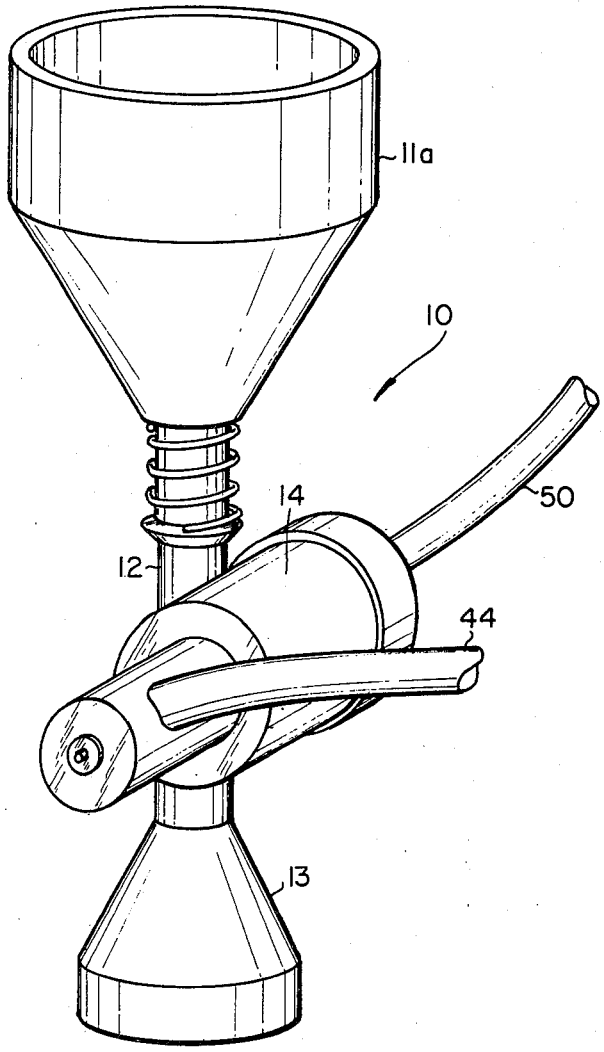
FIG. 1 is a perspective view of a device embodying the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
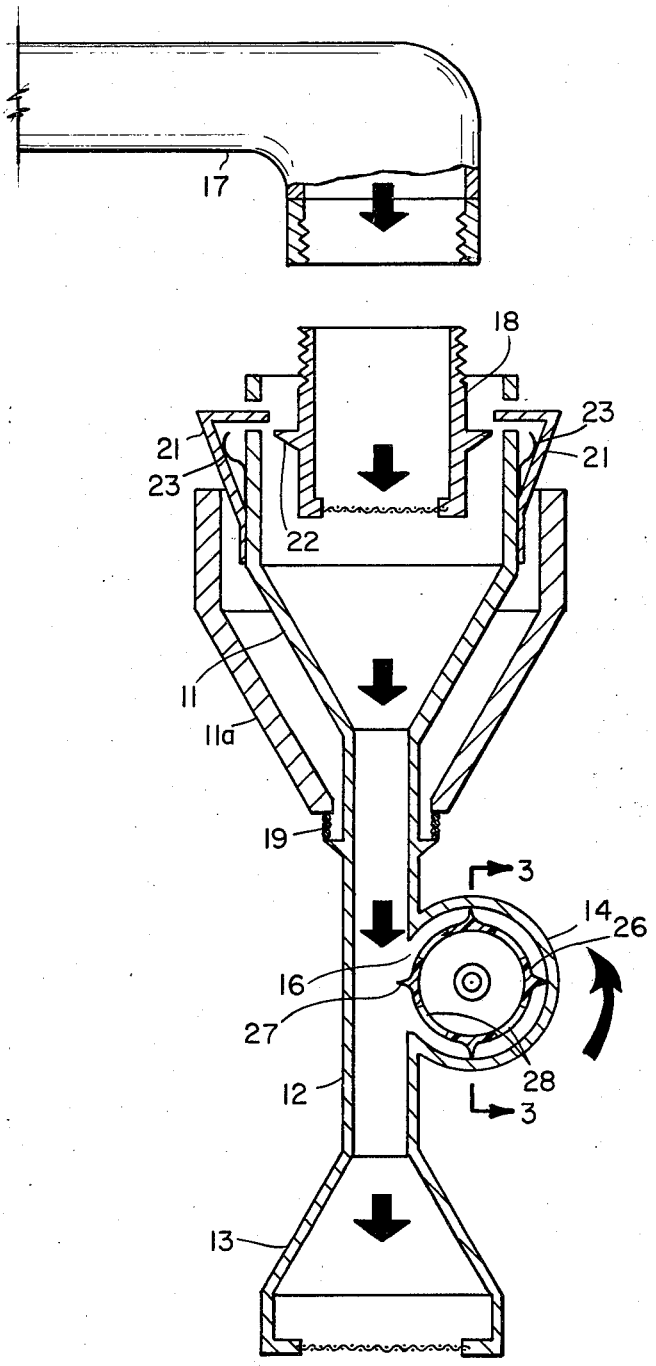
FIG. 2 is a side sectional view of the device of FIG. 1 and showing its connection to a conventional domestic water faucet.

Referring initially to FIGS. 1 and 2, one embodiment of the device embodying the present invention may be seen to comprise a Venturi tube element 10, having a movable shell 11*a* encircling a converging portion 11 of tube element 10, a throat portion 12 and a diverging portion or diffuser 13. A housing 14 overlies an aperture 16 in the sidewall of the throat 12.

In FIG. 2 a conventional domestic water faucet is indicated at 17. The mouth of the converging portion 11 of the apparatus is adapted for releasable attachment to the faucet by means of an adapter 18 which is externally threaded to fit the internally threaded faucet show; the adapter could, alternatively, be internally threaded to attach to an externally threaded faucet. The shell 11*a* is urged upwardly by compression spring 19 (shown compressed in FIG. 2). The upper portion of shell 11*a*, when manually released and moved upwardly from its position of FIG. 2 by spring 19, drives four spring clips 21 (FIG. 2) radially inward to engage and rest on the annular flange 22 on the adapter 18. Spring leaves 23 urge the clips 21 outwardly when released by manual downward movement of shell 11*a*. This apparatus permits convenient attachment and detachment of the Venturi device to a conventional faucet, manual downward displacement of shell 11*a*, only, being necessary for positioning the converging portion 11 in water receiving relation to the adapter 18.

The housing 14 overlies the throat aperture 16 and encloses a turbine rotor 26 having vanes or blades 27 extending through the throat aperture. A removable cap 30 forms a part of the housing. Diametric passages 28 extend through the rotor and are positioned between the rotor blades 27 so that the interior of the housing communicates with aperture 16 no matter what the rotational position of the blades with respect to the aperture.

The rotor 26 is carried by a shaft 31 journalled by a sealed bearing 32 (FIG. 3) in one end of the housing 14 and at its opposite end in a sealed bearing 33 in the reduced portion 14*a* of the housing. The reduced diameter portion 14*a* of the housing, as may best be seen in FIG. 3, encloses a vacuum controlling portion 34 of the rotor 26. The vacuum rotor 34 is of hollow, cylindrical configuration and is provided with diametrically opposite apertures 36. As may best be seen in FIG. 4, the housing portion 14*a* has a suction aperture 37 therein. A rigid, tubular fitting 38 extends through the aperture and its inner end engages the surface of rotor 34 so that communication through aperture 37 to the interior of rotor 34 is periodically opened and closed as apertures 36 are moved into and out of registration with aperture 37 when rotor 26 rotates. The interior of the portion 34 of the rotor 26 is continuously in communication with the interior of the throat portion 12 so that reduced pressure in the Venturi is communicated.

The fitting 38 carries a flexible tube or hose 41 whose distal end is secured on a rigid tubular member 42 having a series of apertures 43 in its sidewall. The member 42 receives a rigid, tubular handle 44 which, in turn, carries suction head 46. The handle 44 may be moved to selectively mask or unmask all or a portion of apertures 43. If desired, to produce precise adjustment, the member 42 and 44 may be threadedly coupled to one another. The arrangement is such that the head 46 can be readily replaced by other heads of differing shapes and capacity.

Figure 3:
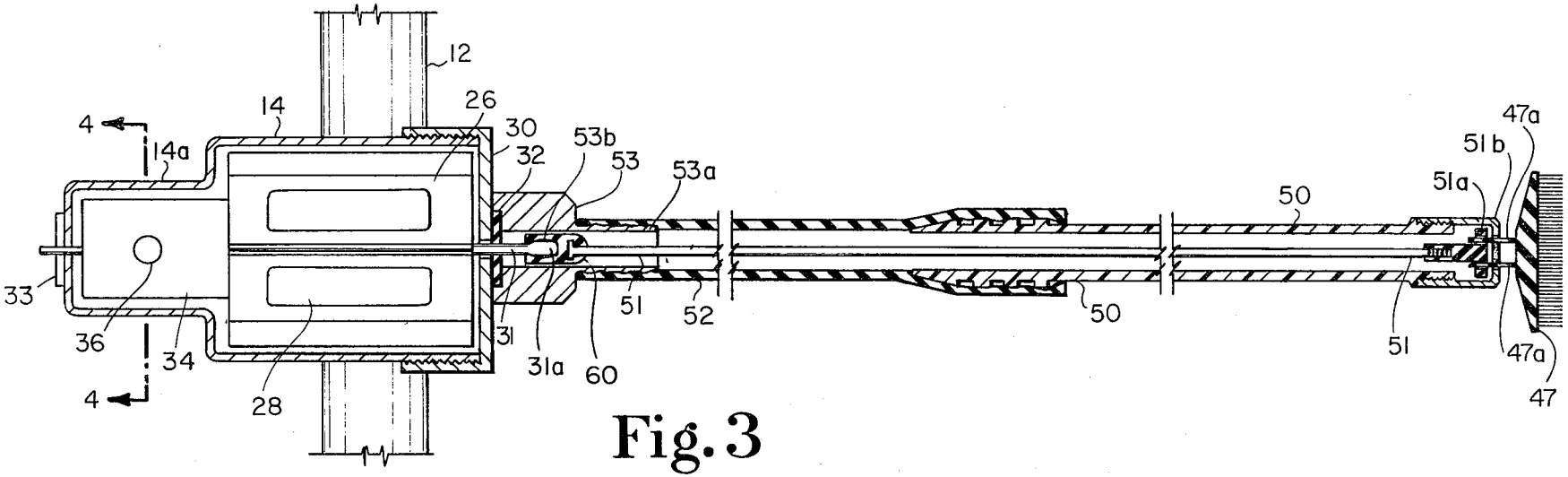
FIG. 3 is a side sectional view taken generally along the line 3—3 of FIG. 2.
Figure 4:
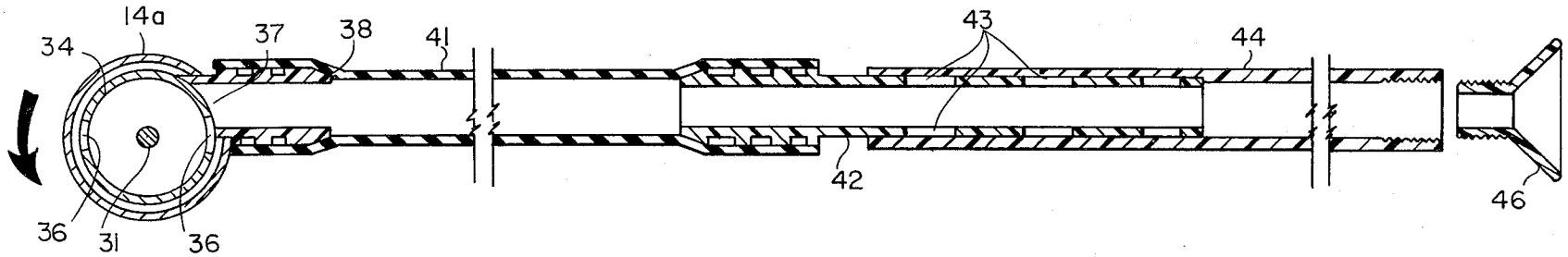
FIG. 4 is a side sectional view taken generally along the line 4—4 of FIG. 3

The rotary motion provided shaft 31 by rotor 26 is transmitted to a remote facial brush 47 by means shown in FIG. 3. This includes a central, flexible shaft or wire 51 which may be threaded at its free end to attach to an adapter 51*a* which removably couples to facial brush 47. The adapter 51*a* rotates in a bearing cap 51*b* threadedly attached to a rigid plastic handle 50. The brush 47 has protruding from its elastomeric base two spaced parallel elements 47*a*, which extend freely through an opening in the end of bearing cap 51*b*. The elements 47*a* are removably pushed through corresponding spaced apertures in adapter 51*a* and the tips of the elements 47*a* may be enlarged or upset slightly to retain them in their position extending through the adapter 51*a*. By inserting or withdrawing the elements 47*a* from the adapter the brush 47 can be conveniently installed or removed from the adapter. Other brushes of differing size or tactile consistency, or other similar implements may thus be readily substituted at the working end of the device.

The wire 51 is enclosed in the rigid plastic handle 50 which is received on a flexible tube 52 which extends to and is removably received on a fitting 53 which, in turn, is rigidly secured at its base on the end face of housing cap 30. The tube 52 may be separated or pulled from the neck portion 53*a* of the fitting 53. A separable junction between shaft 31 and flexible wire 51 is formed by the resilient coupling element 60, formed of any suitable elastomeric material. The coupling may be rigidly and permanently affixed to the end of wire 51 and be provided with a blind hole 53*b* which is of slightly flattened or oval configuration in cross-section and is enlarged slightly at its inner end to accommodate the slightly upset or enlarged tip portion 31*a* of shaft 31. The portion of shaft 31 within hole 53*b* is also somewhat flattened or oval in cross-section so that, with the shaft inserted in the coupling element, the rotation of the shaft is transmitted to the coupling element 60 and wire 51 without slippage. The arrangement is such that the wire 51 and its attached coupling element 60 may be pulled or detached from the shaft 31, the element 60 deforming sufficiently to permit the top 31*a* of the shaft to slide through the hole 53*b*. This separable connection transmits rotary motion of the shaft 31 to wire 51 but permits separation of these elements when tube 52 is removed from fitting 53.

In operation, with the converging portion of the device receiving water flow from faucet nozzle 17, the turbine rotor 26 will be rotated by the kinetic energy of the flowing water. Further, the static pressure at the aperture 16 will be reduced with the increase in velocity of water flow through the throat portion 12. The facial brush 47 will be rotated by the turbine rotor and the vacuum induced in the housing 14 and portion 14*a* will appear as a continuously pulsating suction at the vacuum head 46. The suction will pulsate due to the closing and opening of the vacuum passages as rotor portion 34 moves apertures 36 into and out of registration with passage 37. The degree of suction available at the head 46 may be varied by moving tubular handle 44 to uncover, to various degree, the apertures 43. By providing more or less apertures 36 in the rotor portion and by changing the size of apertures 36, the duration and frequency of the vacuum pulsations may be varied.

A program for use of the device may include applying a detergent or a medicinal compound to the affected facial surfaces. The debris and oils may be effectively removed from the facial surfaces by first utilizing the suction head 46 to apply a pulsating vacuum and then by scrubbing the surfaces with the facial brush 47.

The device is particularly adapted for home use and can be easily attached to or detached from the nozzle of a conventional domestic water faucet. The flexible tubes 42 and 50 permit the vacuum head and the facial brush to be used remotely before a mirror not immediately adjacent the water-supplying faucet.

I claim:

1. A facial treatment device comprising a Venturi tube having the mouth of the converging portion adapted for attachment to a conventional bathroom water faucet, an aperture in the throat portion of said tube and a housing overlying said aperture, a turbine rotor mounted within said housing for rotation on an axis transverse to the longitudinal axis of said Venturi tube, said rotor having vanes extending through said throat aperture whereby said rotor is rotated by water moving through said Venturi tube, a remote facial brush operatively connected to said turbine rotor for rotation thereby, a vacuum controlling rotor of hollow cylindrical configuration within said housing and connected to said turbine rotor for coaxial rotation thereby, said housing having a suction aperture therein, a remote suction head connected by a flexible tube to said housing aperture, a plurality of apertures in said vacuum controlling rotor longitudinally aligned with said vacuum aperture, whereby rotation of said vacuum controlling rotor periodically opens and closes said suction aperture to pulse the vacuum appearing at the suction head caused by the static pressure reduction in said housing produced by the increase in kinetic energy of water flowing past said throat aperture.

2. A facial treatment device as claimed in claim 1 in which a rigid tubular member is interposed between said suction head and the distal end of said flexible tube, a movable tubular handle movably mounted on said tubular member, and apertures in the tubular member selectively obstructed by adjusting the position of said handle with respect to said tubular member for adjusting the degree of vaccum appearing at said suction head.

3. A facial treatment device as claimed in claim 1 in which diametric passages extend through said turbine rotor, said passages being located between the rotor blades so that the interior of said housing communicates with said throat aperture for all positions of the rotor blades with respect thereto.

4. A facial treatment device as claimed in claim 1 in which said remote facial brush has a flexible connecting means extending between the brush and said turbine rotor.

5. A facial treatment device as claimed in claim 4 in which said facial brush is detachable from said flexible connecting means.

* * * * *